United States Patent [19]

Kadokura et al.

[11] Patent Number: 5,012,156

[45] Date of Patent: Apr. 30, 1991

[54] DISPERSION-TYPE ELECTROLUMINESCENCE DEVICE

[75] Inventors: Hidekimi Kadokura; Hiroshi Yoshitake; Masayoshi Tanahashi, all of Niihama, Japan

[73] Assignee: Sumitomo Chemical Company, Limited, Osaka, Japan

[21] Appl. No.: 362,459

[22] PCT Filed: Sep. 28, 1988

[86] PCT No.: PCT/JP88/00984

§ 371 Date: May 24, 1989

§ 102(e) Date: May 24, 1989

[87] PCT Pub. No.: WO89/03163

PCT Pub. Date: Apr. 6, 1989

[30] Foreign Application Priority Data

Sep. 29, 1987 [JP] Japan ..... 62-247425

[51] Int. Cl.[5] ..... H01J 63/04

[52] U.S. Cl. ..... 313/509; 313/502; 313/504; 313/506

[58] Field of Search ..... 313/502, 506, 509, 511, 313/512, 505, 504

[56] References Cited

U.S. PATENT DOCUMENTS 4,143,297 3/1979 Fischer ..... 313/502
4,482,580 11/1984 Emmett et al. ..... 313/509
4,767,679 8/1988 Kawachi ..... 313/512

FOREIGN PATENT DOCUMENTS 38-5759 5/1963 Japan .
59-14878 4/1984 Japan .

OTHER PUBLICATIONS

Database Derwent World Patent Index, An 80-33981C (19); JP-B-80 014 516 (Matsushita Elec. Ind. K.K.) 17-04-1980 *Abstract*.

*Primary Examiner*—Donald J. Yusko
*Assistant Examiner*—Diab Hamadi
*Attorney, Agent, or Firm*—Stevens, Davis, Miller & Mosher

[57] ABSTRACT

The object of the present invention is to provide a dispersion-type electroluminescence device low in current density, excellent in luminous efficiency and less in uneven luminance. For attaining this object, dented portions present in an upper part of a luminous layer of dispersion-type electroluminescence device having a back electrode layer and, laminated thereon, an insulator layer, a luminous layer and a transparent electrode layer are coated with a resin composition having a dielectric constant which is lower than that of a dielectric resin composition used for formation of the luminous layer which is 5 or higher and a transparent electrode layer is than laminated thereon.

1 Claim, 1 Drawing Sheet

DISPERSION-TYPE ELECTROLUMINESCENCE DEVICE

TECHNICAL FIELD

The present invention relates to a dispersion-type electroluminescence device excellent in electrical characteristics (hereinafter referred to as "dispersion-type EL device") and more particularly to a dispersion-type EL device which is low in current density, excellent in luminous efficiency and prevented from formation of uneven luminance.

BACKGROUND ART

FIG. 1 is a longitudinal-sectional view of a conventional dispersion-type EL device wherein 1 indicates a back electrode made of Al foil and the like, 2 indicates an insulator layer, 3 indicates a luminous layer, 4 indicates a transparent electrode, 5 indicates a moisture absorbing film and 6 indicates a moisture-proof film.

The luminous layer in a dispersion-type EL device is usually formed by dispersing phosphor powders of about 10–about 50 μm in particle size in a dielectric cellulosic resin composition dissolved in an organic solvent and coating this dispersion on an insulator layer at a film thickness of about 20—about 70 μm by doctor blade method, silk screening method, etc.

However, according to the above procedure, it is difficult to arrange uniformly the phosphor particles and coat the luminous layer with a smooth surface and there occur spaces between the phosphor particles, resulting in dented portions where the particles are not present, namely, uneven surface of the luminous layer.

In the device made by the conventional method according to which a transparent electrode is formed over the luminous layer of such surface state, it is difficult to apply uniform electrical field to the phosphor particles owing to difference in distance between electrodes and as a result not only scattering of luminance is brought about, but also current is concentrated to the dented portions to cause increase of current density of the EL device and deteriorate the luminous efficiency.

Under the circumstances, the inventors have conducted intensive research in an attempt to obtain a dispersion-type EL device which has a low current density, is excellent in luminous efficiency and is free from uneven luminance. As a result, it has been found that a dispersion-type EL device which satisfies the above requirements can be obtained by filling the dented portions on the surface of the luminous layer with a dielectric resin composition having lower dielectric constant than that of the dielectric resin composition which constitutes the luminous layer, thereby to nearly smoothen the surface of the luminous layer and thereafter producing a usual EL device therefrom. Thus, the present invention has been accomplished.

DISCLOSURE OF INVENTION

The present invention resides in providing a dispersion-type EL device comprising a back electrode layer and, laminated thereon, an insulator layer, a luminous layer and a transparent electrode layer wherein dented portions present in upper parts of the luminous layer are coated with a resin composition which is lower in dielectric constant than a dielectric resin composition used for formation of the luminous layer, but which has a dielectric constant of about 5 or higher.

Figure 1:
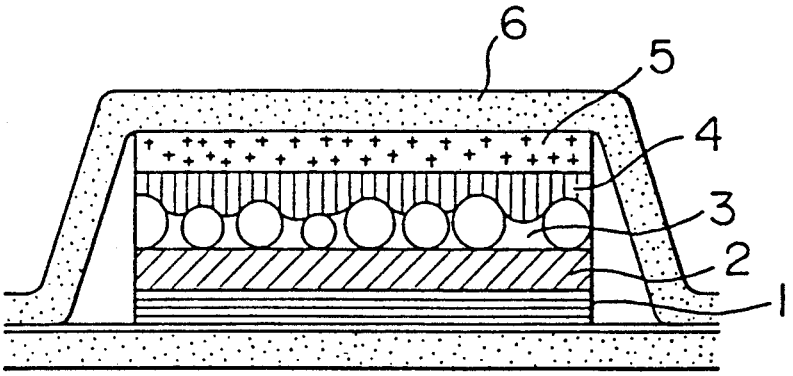
FIG. 1 (PRIOR ART)
FIG. 1 s a longitudinal section of a conventional dispersion-type EL device and FIG. 2 shows a longitudinal section of a dispersion-type EL device of the present invention wherein the reference numbers have the following meaning.

1 --- back electrode; 2 --- insulator layer; 3 --- luminous layer; 4 --- transparent electrode; 5 --- moisture absorption film; 6 --- moisture-proof film; 7 --- low dielectric resin composition layer The present invention will be explained in more detail referring to the drawings.

Figure 2:
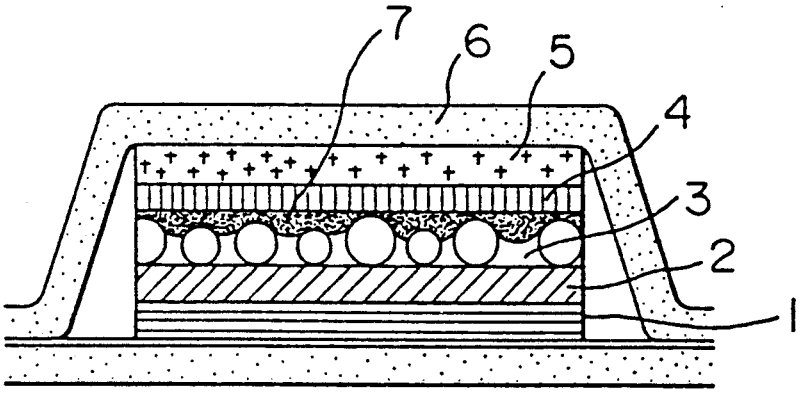

FIG. 2 is a longitudinal-sectional view of the dispersion-type EL device of the present invention.

DESCRIPTION OF THE PREFERRED EMBODIMENT

In FIG. 2, 1 indicates a back electrode made of aluminum foil and the like and 2 indicates an insulator layer formed by coating on the back electrode a mixture prepared by dispersing highly insulating powders such as barium titanate in a highly dielectric resin composition by roll coater or doctor blade.

3 indicates a luminous layer formed by coating a mixture prepared by dispersing phosphor powders mainly composed of zinc sulfide which have an average particle size of about 10 μm–about 50 μm in a composition comprising at least one highly dielectric resin having normally a dielectric constant of about 15 or higher such as cyanoethylated cellulose, cyanoethylated glycidolpullulan, cyanoethylated sucrose, etc. which are dissolved in an organic solvent such as dimethylformamide on the insulator layer 2 at a thickness of about 20 μm–about 70 μm by roll coater or doctor blade and drying it by heating.

The thus formed luminous layer 3 has an uneven surface owing to scattering in particle size of adjacent phosphor particles and release of volatile matter in resin composition at the time of heating and drying. When the transparent electrode layer is provided on the luminous layer as it is, electric current is concentrated to the dented portions and in an extreme case, there is the possibility of shortcircuiting.

Therefore, according to the present invention, low dielectric constant resin composition layer 7 is formed by coating the dented portions on the upper surface of luminous layer 3 with a resin composition lower in dielectric constant than the high dielectric constant resin composition used for formation of the luminous layer.

The resin composition can be those which have lower dielectric constant than the resin composition used for luminous layer 3 and have a dielectric constant of about 5 or higher and known resin compositions such as cellulosic compounds, epoxy resin, phenoxy resin and mixtures thereof may be used.

When a low dielectric constant composition of less than about 5 in dielectric constant is used as the resin composition for coating the dented portions, field strength applied to phosphor powders decreases to cause deterioration of luminous characteristics such as uneven luminance and such resin composition is not preferred.

When the same resin composition as the high dielectric constant resin composition which forms the luminous layer is filled in the dented portions, the effect to reduce the electric current which passes the dented portions is small and if a large amount of the resin composition is coated in order to obtain sufficient effect, reduction of luminance is brought about. Thus, this is not preferred.

Differences in dielectric constant of the resin composition for coating the dented portions and of the resin composition used for luminous layer vary depending on the degree of denting of the portions, namely, thickness of resin composition for coating the dented portions and, besides, thickness of luminous layer, but normally the differences can be about 1 or more, preferably about 2 or more. The optimum values can be easily obtained by simple preliminary experiments in accordance with the production conditions employed.

Thickness of the low electric constant resin composition may be such levels that can fill the denoted portions and can be about 5 $\mu$ or less, preferably about 1 $\mu$ or less measured from the peak of the highest projecting portions of the luminous layer.

When the thickness of the coat from the peak of the highest projecting portion is too large, field strength applied to the phosphor powders decreases and this is not preferred.

Coating methods for the low dielectric constant resin composition is not limitative as far as a smooth coating surface can be formed. Usually, the resin composition is dissolved in a suitable solvent such as dimethylformamide and this solution is coated by doctor blading method or silk screening method.

Transparent electrode layer 4 of, for example, ITO is formed by conventional method on the luminous layer the surface of which is thus smoothened by coating the dented portions with a low dielectric resin composition. Then, if necessary, moisture absorbing film 5 is put thereon and thereafter, the whole laminate is sealed by moisture-proof film 6. Thus, a dispersion-type EL device can be formed.

When the dented portions on the surface of a luminous layer are coated with a low dielectric constant resin composition to smoothen the surface of the luminous layer as in the present invention, not only the distance between electrodes becomes uniform, but also scattering in resistance of electric current which passes through the phosphor particles and the resin layer is decreased. Thus, electric current can be reduced and luminous efficiency can be increased and besides there are no partial differences in field strength applied to phosphor powders and uneven luminance can be prevented.

EFFECT OF INVENTION

As explained above, the present invention can provide an EL device reduced in electric current and electric power and of high luminous efficiency.

Further, owing to reduction of electric power, compaction of driving circuit system and reduction of cost has become possible and hence the industrial value is remarkable.

BEST MODE FOR CARRYING OUT THE INVENTION

The present invention will be explained in more detail by the examples.

In the examples, part means part by weight. Dielectric constant of resin composition was measured in the following manner: The resin composition was press molded with heating to a thickness of 2 mm and then dielectric constant of this press molded sheet was measured by a dielectric constant measuring apparatus (Multifrequency LCR meter manufactured by Yokogawa Hewlett Packard Co.) at 25° C. and 1 KHz.

EXAMPLE 1 AND COMPARATIVE EXAMPLES 1-2

As shown in FIG. 2, a mixture comprising 40 parts of zinc sulfide phosphor powders (average particle size: 25 $\mu$), 15 parts of a high dielectric constant cellulose resin (dielectric constant: 18) and 45 parts of dimethylformamide (hereinafter referred to as "DMF") was coated on insulator layer 2 comprising $BaTiO_3$ and a high dielectric constant cellulosic resin composition provided on aluminum foil 1 by doctor blading method and heated and dried at 130° C. for 10 minutes to form phosphor layer 3 of 50 $\mu$m thick.

Then, on the phosphor layer 3 was coated a mixture comprising 10 parts of a resin composition prepared by mixing a phenoxy resin and a cellulosic resin so as to give a dielectric constant of 12 and 90 parts of DMF at such a thickness of less than 1 $\mu$ over the peak of the highest projecting portion by a doctor blade and this was heated and dried at 130° C. x 10 minutes.

ITO transparent electrode 4 was provided on the smoothed luminous layer 3 and further the whole was covered with polychlorotrifluoroethylene for attaining moistureproof effect.

The thus obtained EL device was subjected to the driving conditions of 115V-400HZ to emit light.

The results are shown in Table 1.

For comparison, EL device (Comparative Example 1) which was not subjected to the smoothing treatment of the surface of the phosphor layer and EL device (Comparative Example 2) smoothed in the same manner as in Example 1 except that the cellulosic resin having a dielectric constant of 18 which formed the phosphor layer was used in place of the cellulosic resin having a dielectric constant of 12 were also tested for their performances.

The results are also shown in Table 1 as Comparative Examples 1 and 2.

TABLE 1

| | Voltage (V) | Frequency (Hz) | Luminance (cd/m$^2$) | Current (mA/cm$^2$) | Electric power (mW/cm$^2$) | Luminous efficiency (lm/W) |
|---|---|---|---|---|---|---|
| Example 1 | 115 | 400 | 61.3 | 0.15 | 4.5 | 4.3 |
| Comparative Example 1 | 115 | 400 | 61.1 | 0.20 | 7.4 | 2.6 |
| Comparative Example | 115 | 400 | 60.0 | 0.18 | 5.4 | 3.5 |

INDUSTRIAL APPLICABILITY

The dispersion-type electroluminescence device is low in current density, excellent in luminous efficiency and less in unevenness of luminance and hence is most suitable as a thin and lightweight face-type illuminant in specific places for application to low-power consumption lighting such as a back light for liquid crystal display devices in word processors, number plates of automobiles and various emergency lights of buildings.

What is claimed is:

1. A dispersion-type electroluminescence device comprising a back electrode layer and, laminated thereon, an insulator layer, a luminous layer and a transparent electrode layer wherein dented portions present in the upper part of the luminous layer are coated with a resin composition having a dielectric constant which is at least about 5 but lower than that of the dielectric resin composition, which is at least 15, used for formation of the luminous layer and which is, the thickness of coating of the dielectric resin composition formed in the dented portions of the luminous layer being not greater than about 5μ over a peak of the highest projecting portion of the luminous layer.

* * * * *